US009695009B2

(12) United States Patent
Okunaka

(10) Patent No.: US 9,695,009 B2
(45) Date of Patent: Jul. 4, 2017

(54) ELEVATOR SYSTEM

(75) Inventor: Takayoshi Okunaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 465 days.

(21) Appl. No.: 14/395,692

(22) PCT Filed: May 1, 2012

(86) PCT No.: PCT/JP2012/061561
§ 371 (c)(1),
(2), (4) Date: Oct. 20, 2014

(87) PCT Pub. No.: WO2013/164882
PCT Pub. Date: Nov. 7, 2013

(65) Prior Publication Data

US 2015/0060212 A1 Mar. 5, 2015

(51) Int. Cl.
*B66B 9/00* (2006.01)
*B66B 1/24* (2006.01)

(52) U.S. Cl.
CPC ..... *B66B 1/2466* (2013.01); *B66B 1/2433* (2013.01); *B66B 2201/103* (2013.01); *B66B 2201/231* (2013.01)

(58) Field of Classification Search
CPC ..... B66B 1/2466; B66B 1/2433; B66B 2201/103; B66B 2201/231
(Continued)

(56) References Cited

U.S. PATENT DOCUMENTS 4,632,224 A * 12/1986 Nowak ..... B66B 1/2458 187/387
4,993,518 A * 2/1991 van Straaten ..... B66B 1/2458 187/387
(Continued)

FOREIGN PATENT DOCUMENTS

JP 11-060088 A 3/1999
JP 2000-272847 A 10/2000
(Continued)

OTHER PUBLICATIONS

International Preliminary Report on Patentability and Written Opinion issued Nov. 13, 2014 in PCT/JP2012/061561.
(Continued)

*Primary Examiner* — Anthony Salata
(74) *Attorney, Agent, or Firm* — Oblon, McClelland, Maier & Neustadt, L.L.P.

(57) ABSTRACT

An elevator system includes a group control device (12) and a destination call registration device (9). The group control device (12) performs group control of a plurality of elevator devices. Each of the elevator devices includes a plurality of cars which ascend and descend in the same shaft. The destination call registration device (9) is installed in an elevator hall. Moreover, the group control device (12) includes a first determination unit (15) and an assigned car determination unit (18). The first determination unit (15) tentatively assigns a call newly registered from the destination call registration device (9) to a first car, and excludes the first car from candidate cars of a first group in a case where a second car arranged above or below the first car stops at the hall before the first car. The assigned car determination unit (18) selects a car to which the new registration call is assigned from the candidate cars of the first group.

7 Claims, 3 Drawing Sheets

(58) Field of Classification Search
USPC ..... 187/247, 249, 277, 380–389, 393, 902
See application file for complete search history.

(56) References Cited

U.S. PATENT DOCUMENTS 5,844,179 A * 12/1998 Walker ..... B66B 1/2416 187/382
5,865,274 A * 2/1999 Kiji ..... B66B 1/2458 187/249
6,176,351 B1 * 1/2001 Ikeda ..... B66B 1/2458 187/387
6,360,849 B1 3/2002 Hikita
6,505,712 B2 * 1/2003 Hattori ..... B66B 1/2458 187/382
6,508,333 B2 * 1/2003 Kostka ..... B66B 1/2458 187/382
7,389,857 B2 * 6/2008 Hikita ..... B66B 1/2466 187/249
7,392,883 B2 * 7/2008 Hikita ..... B66B 1/2466 187/249
7,392,884 B2 * 7/2008 Hikita ..... B66B 1/2433 187/249
7,487,860 B2 * 2/2009 Hikita ..... B66B 1/2433 187/249
7,784,588 B2 * 8/2010 SikShin ..... B66B 1/2433 187/249
8,978,833 B2 * 3/2015 Suzuki ..... B66B 1/2458 187/382

FOREIGN PATENT DOCUMENTS

JP 2001-048431 A 2/2001
JP 2002-003099 A 1/2002
JP 3435882 B2 8/2003
JP 2004-131226 A 4/2004
JP 3889471 B2 3/2007

OTHER PUBLICATIONS

International Search Report issued Jun. 19, 2012 in PCT/JP2012/061561 filed May 1, 2012.

* cited by examiner

No. 4, 8: CAR CONTROL DEVICE
No. 14 : STORAGE UNIT
No. 15 : FIRST DETERMINATION UNIT
NO. 16 : SECOND DETERMINATION UNIT
NO. 17 : ASSIGNED CANDIDATE CAR SELECTION UNIT
NO. 18 : ASSIGNED CAR DETERMINATION UNIT

S105: SELECT FROM CANDIDATE CARS OF FIRST GROUP BASED ON COMPREHENSIVE EVALUATION VALUE
S107: SELECT FROM CANDIDATE CARS OF SECOND GROUP BASED ON COMPREHENSIVE EVALUATION VALUE

No. 4a, 8a : CAR CONTROL DEVICE
No. 14 : STORAGE UNIT
No. 15 : FIRST DETERMINATION UNIT
NO. 16 : SECOND DETERMINATION UNIT
NO. 17 : ASSIGNED CANDIDATE CAR SELECTION UNIT
NO. 18 : ASSIGNED CAR DETERMINATION UNIT

ELEVATOR SYSTEM

TECHNICAL FIELD

The present invention relates to an elevator system.

BACKGROUND ART

Devices for performing group control of double-deck elevators are disclosed in Patent documents 1 through 4 listed below.

The device disclosed in each of Patent documents 1 and 2 allows a speaker or a display to provide predetermined guidance such that a passenger does not get in a wrong car that is an upper car or a lower car. In the device disclosed in each of Patent documents 3 and 4, a new hall call is assigned in consideration of a hall call that has been already registered.

CITATION LIST

Patent Literature

Patent Literature 1: Japanese Patent No. 3889471

Patent Literature 2: Japanese Patent Laid-Open No. 2002-3099

Patent Literature 3: Japanese Patent Laid-Open No. 2000-272847

Patent Literature 4: Japanese Patent No. 3435882

SUMMARY OF INVENTION

Technical Problem

In a related-art device, a notification device such as a speaker and a display has to be installed so that a passenger does not get in a wrong car. The passenger needs to listen to the announcement or see the display to check whether he/she is in a correct car (an upper car or a lower car).

The present invention was made in order to solve the above problem and an object of the present invention is to provide an elevator system for enabling a passenger to get in an appropriate car without using a speaker and a display.

Solution to Problem

An elevator system of the present invention is a system which comprises a group control device which performs group control of a plurality of elevator devices, and a destination call registration device, installed in an elevator hall, by which a passenger registers a destination call in the hall. Each of the elevator devices includes a plurality of cars that ascend and descend in the same shaft. The group control device includes a first determination unit which tentatively assigns a call newly registered from the destination call registration device to a first car, and excludes the first car from candidate cars of a first group in a case where a second car arranged above or below the first car stops at the hall before the first car, and an assigned car determination unit which selects a car to which the new registration call is assigned from the candidate cars of the first group.

An elevator system of the present invention is a system which comprises a group control device which performs group control of a plurality of elevator devices, and a destination call registration device, installed in an elevator hall, by which a passenger registers a destination call in the hall. Each of the elevator devices includes a plurality of cars that ascend and descend in the same shaft. The group control device includes a second determination unit which tentatively assigns a call newly registered from the destination call registration device to a first car, and excludes the first car from candidate cars of a first group in a case where the first car and a second car arranged above or below the first car successively stop at the hall, and an assigned car determination unit which selects a car to which the new registration call is assigned from the candidate cars of the first group.

Advantageous Effects of Invention

The elevator system of the present invention enables a passenger to get in an appropriate car without using a speaker and a display.

DESCRIPTION OF EMBODIMENTS

Figure 1:
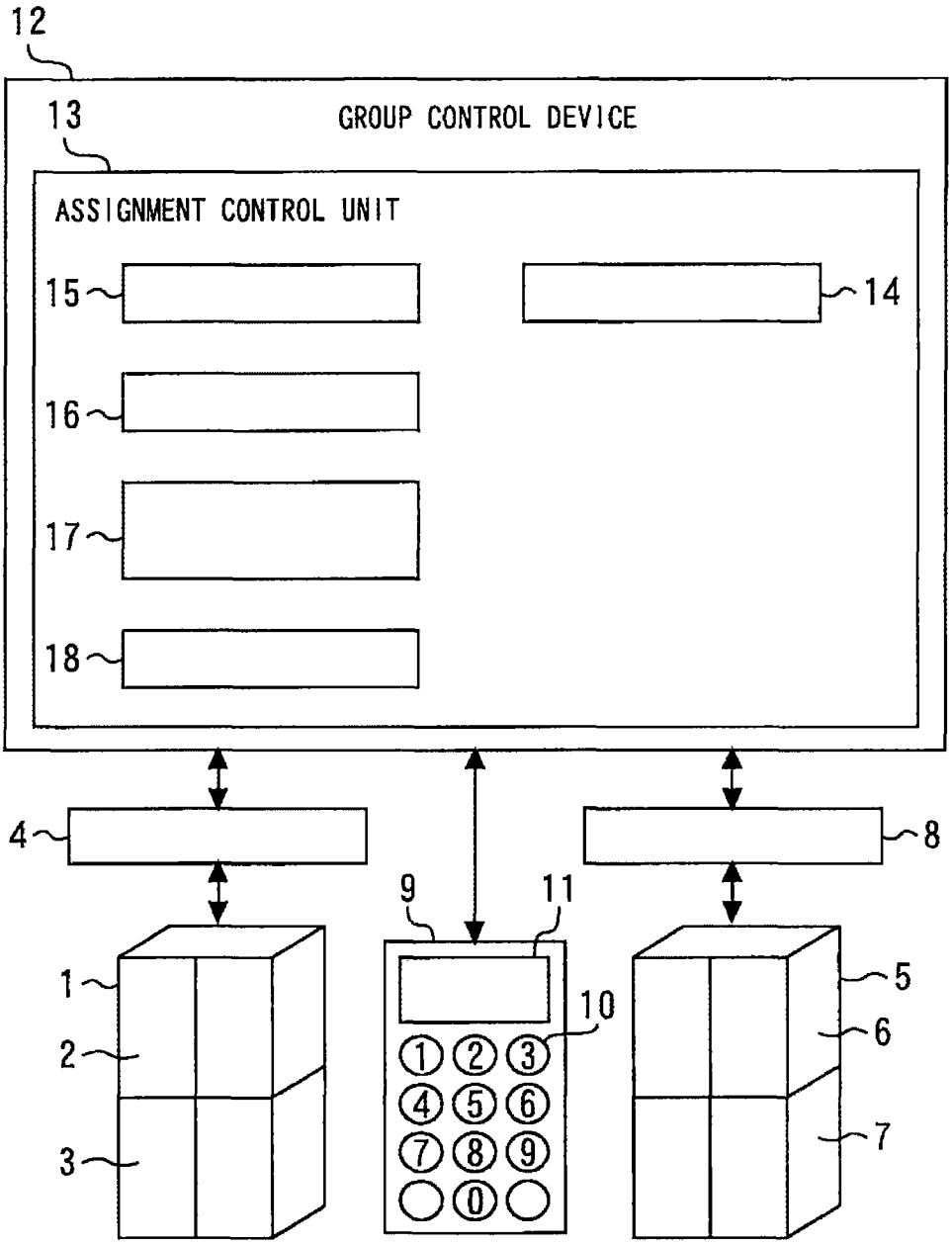
FIG. 1 is a diagram illustrating a configuration of an elevator system according to a first embodiment of the present invention.

The present invention will be described in detail with reference to the accompanying drawings. In each of the drawings, identical reference numerals refer to identical or corresponding parts. Redundant descriptions are appropriately simplified or omitted.

First Embodiment

FIG. 1 is a diagram illustrating a configuration of an elevator system according to a first embodiment of the present invention.

Reference numeral 1 denotes a car device which ascends and descends in an elevator shaft. The car device 1 includes an upper car 2 and a lower car 3 where passengers ride. The upper car 2 and the lower car 3 are vertically coupled. The lower car 3 is arranged below the upper car 2. The upper car 2 and the lower car 3 integrally and vertically move in the shaft.

Reference numeral 4 denotes a car control device which controls the car device 1. The car control device 4 controls opening and closing of doors and travelling of the car device 1. The car control device 4 separately controls the opening and closing of the door of the upper car 2, and the opening and closing of the door of the lower car 3.

The upper car 2 includes a car operation panel (not illustrated). The car operation panel is a device by which a passenger registers a destination call in the upper car 2. The car operation panel includes, for example, a destination button (not illustrated) for each floor at which the upper car 2 stops. A passenger operates the destination button to input his/her destination floor. When the destination floor is input from the car operation panel, the car control device 4 outputs a corresponding call registration request to a group control device 12. This call registration request includes information on the car (i.e., the upper car 2) in which the destination floor is input, and information on the input destination floor.

The lower car 3 includes a car operation panel (not illustrated) as similar to the upper car 2. The car operation panel included in the lower car 3 functions similar to that included in the upper car 2. When a destination floor is input from the car operation panel of the lower car 3, the car control device 4 outputs a corresponding call registration request to the group control device 12. This call registration request includes information on the car (i.e., the lower car 3) in which the destination floor is input, and information on the input destination floor.

Reference numeral 5 denotes a car device which ascends and descends in another shaft. That is, the car device 5 ascends and descends in the shaft different from the shaft in which the car device 1 ascends and descends. The car device 5 includes an upper car 6 and a lower car 7 where passengers ride. The upper car 6 and the lower car 7 are vertically coupled. The lower car 7 is arranged below the upper car 6. The upper car 6 and the lower car 7 integrally and vertically move in the shaft.

Reference numeral 8 denotes a car control device which controls the car device 5. The car control device 8 controls opening and closing of doors and travelling of the car device 5. The car control device 8 separately controls the opening and closing of the door of the upper car 6, and the opening and closing of the door of the lower car 7.

The upper car 6 includes a car operation panel (not illustrated). The car operation panel is a device by which a passenger registers a destination call in the upper car 6. The car operation panel includes, for example, a destination button (not illustrated) for each floor at which the upper car 6 stops. A passenger operates the destination button to input his/her destination floor. When the destination floor is input from the car operation panel, the car control device 8 outputs a corresponding call registration request to the group control device 12. This call registration request includes information on the car (i.e., the upper car 6) in which the destination floor is input, and information on the input destination floor.

The lower car 7 includes a car operation panel (not illustrated) as similar to the upper car 6. The car operation panel included in the lower car 7 functions similar to that included in the upper car 6. When a destination floor is input from the car operation panel of the lower car 7, the car control device 8 outputs a corresponding call registration request to the group control device 12. This call registration request includes information on the car (i.e., the lower car 7) in which the destination floor is input, and information on the input destination floor.

Reference numeral 9 denotes a destination call registration device which is installed in an elevator hall. The destination call registration device 9 may be installed in each of all the halls at which the car devices 1 and 5 stop, or some of the halls. A plurality of destination call registration devices 9 may be installed in one hall.

The destination call registration device 9 is a device by which a passenger registers a destination call in a hall. The destination call registration device 9 includes, for example, input buttons 10 and a display 11. A passenger operates the input button 10 in the hall to input his/her destination floor. When the destination floor is input, the destination call registration device 9 outputs a corresponding call registration request to the group control device 12. This call registration request includes information on (the floor of) the hall in which the destination call registration device 9 is installed, and information on the input destination floor.

The group control device 12 has a function of performing group control of the car device 1 and the car device 5. That is, the group control device 12 controls a plurality of double-deck elevators as one group. The present embodiment represents a case in which the group control device 12 controls a double-deck elevator including the car device 1 and a double-deck elevator including the car device 5 as one example. The group control device 12 may perform group control of three or more double-deck elevators, although a detailed description thereof is not given in the present embodiment.

The group control device 12 includes an assignment control unit 13. The assignment control unit 13 registers a call (a hall call, a destination call) based on the call registration request which has been input. The assignment control unit 13 determines, based on a predetermined condition, a car that should respond to the registered call from the cars controlled by the group control device 12.

The assignment control unit 13 includes a storage unit 14, a first determination unit 15, a second determination unit 16, an assigned candidate car selection unit 17, and an assigned car determination unit 18.

The storage unit 14 stores information on a call (a hall call, a destination call) which is currently registered. For example, the storage unit 14 manages information by making a table to link the information on the registered call to the information on the car (assigned car) which should respond to the registered call, and stores the linked information.

The first determination unit 15 has a function of selecting candidate cars of a first group with respect to a call newly registered from the destination call registration device 9. The first determination unit 15 selects the candidate cars of the first group based on the information stored in the storage unit 14.

For example, when a new call (a hall call, a destination call) is registered by operating the destination call registration device 9 by a passenger, the first determination unit 15 tentatively assigns the new registration call to each of the cars controlled by the group control device 12. In the present embodiment, the first determination unit 15 tentatively assigns the new registration call to each of the upper car 2, the lower car 3, the upper car 6, and the lower car 7 in order. The first determination unit 15 determines whether the passenger may get in a wrong car which is above or below a certain car in a case where the new registration call is tentatively assigned to the certain car. If there is a possibility that the passenger may get in the wrong car in a case where the new registration call is tentatively assigned to the certain car, the first determination unit 15 excludes the tentatively assigned car from the candidate cars of the first group.

For example, consider a case where the first determination unit 15 tentatively assigns a new registration call to the lower car 3.

The first determination unit 15 determines whether the tentative assignment of the new registration call to the lower car 3 causes the upper car 2 to stop at a hall where the passenger is present before the lower car 3 stops at the hall. If the upper car 2 stops at the hall where the passenger is present before the lower car 3, there is a possibility that the passenger may get in the upper car 2 by mistake. In such a case, the first determination unit 15 determines that there is a possibility that the passenger may get in the wrong car. The first determination unit 15 excludes the lower car 3 from the candidate cars of the first group.

On the other hand, if the upper car 2 does not stop at the hall where the passenger is present, and if the lower car 3 stops at the hall where the passenger is present before the upper car 2 even in a case where the upper car 2 stops at the hall, the passenger who registered the new call does not get in the upper car 2 by mistake. In such cases, the first determination unit 15 determines that there is no possibility that the passenger gets in the wrong car. The first determination unit 15 selects the lower car 3 as a candidate car of the first group.

The second determination unit 16 has a function of selecting candidate cars of a second group with respect to a call newly registered from the destination call registration device 9. The second determination unit 16 selects the candidate cars of the second group from the candidate cars of the first group based on the information stored in the storage unit 14.

For example, when a new call (a hall call, a destination call) is registered by operating the destination call registration device 9 by a passenger, the second determination unit 16 tentatively assigns the new registration call to each of the cars controlled by the group control device 12. The second determination unit 16 determines whether a certain car and a car above or below the certain car successively stop at the same hall in a case where the new registration call is tentatively assigned to the certain car. If the upper and lower cars successively stop at the same hall in a case where the new registration call is tentatively assigned to the certain car, the second determination unit 16 excludes the tentatively assigned car from the candidate cars of the first group. The second determination unit 16 selects the car excluded from the candidate cars of the first group as a candidate car of the second group.

The second determination unit 16 may limit a car to which the new registration call should be assigned to the cars selected as the candidate cars of the first group.

The assigned candidate car selection unit 17 selects a car to be an assigned candidate (an assigned candidate car) for the new registration call based on a determination result of the first determination unit 15 and a determination result of the second determination unit 16.

The assigned car determination unit 18 selects a car to be actually assigned (an assigned candidate car) for the new registration call from the assigned candidate cars selected by the assigned candidate car selection unit 17. For example, the assigned car determination unit 18 considers various evaluation items (e.g., waiting time for the passenger, and travel distance of the car) regarding the cars selected as the assigned candidate cars, and then determines the assigned car.

Figure 2:
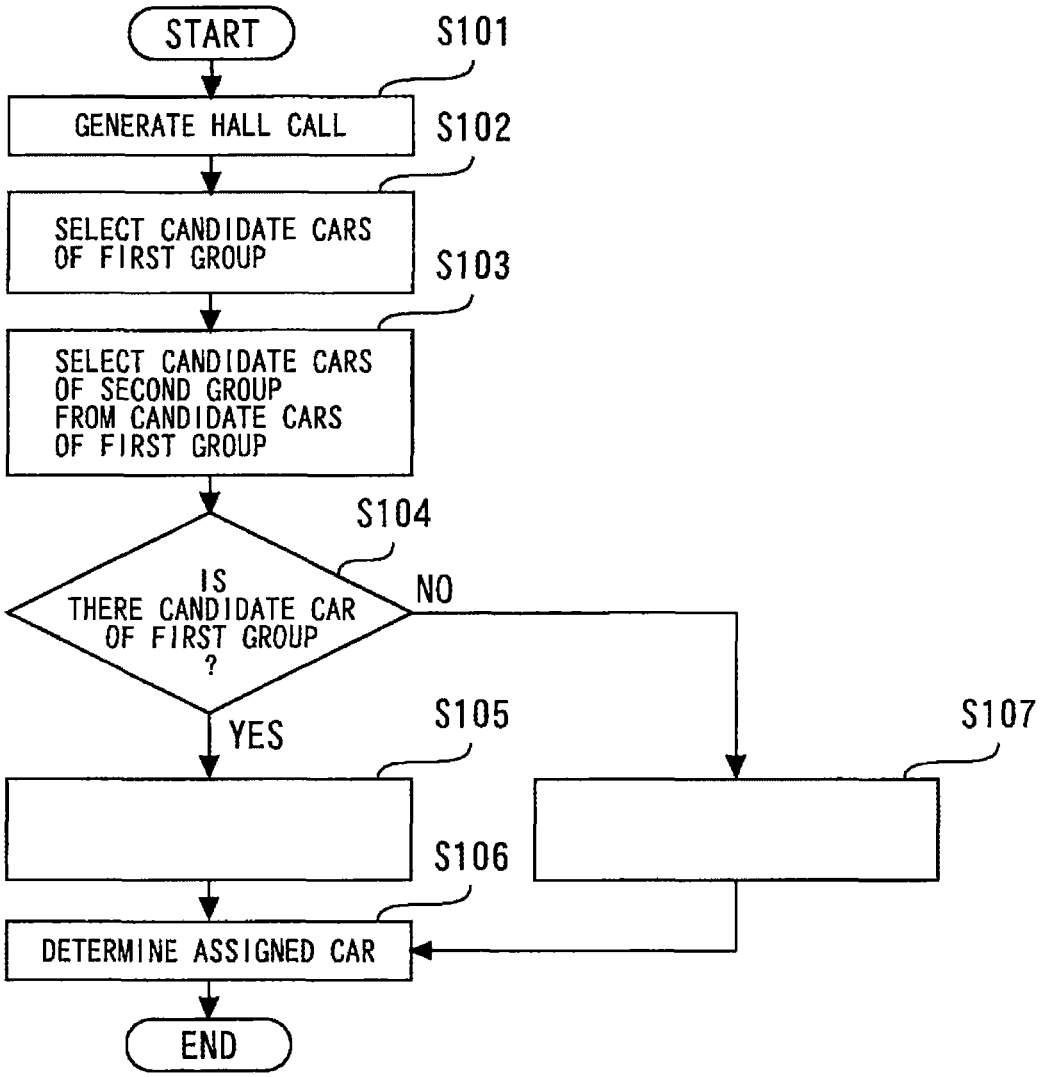
FIG. 2 is a flowchart illustrating operation of the elevator system according to the first embodiment of the present invention.

Next, operation of the elevator system (operation of the group control device 12, in particular) including the above configuration is particularly described with reference to FIG. 2. FIG. 2 is a flowchart illustrating operation of the elevator system according to the first embodiment of the present invention.

When a passenger appropriately operates the destination call registration device 9 in a hall, a call registration request is transmitted from the destination call registration device 9 to the group control device 12. Upon receipt of the call registration request from the destination call registration device 9, the group control device 12 registers a corresponding hall call and a corresponding destination call (S101). For example, the passenger in a hall on a third floor inputs a seventh floor as a destination floor from the destination call registration device 9. Accordingly, in the group control device 12, a hall call of the third floor and a destination call of the seventh floor are registered.

When the calls are newly registered, the first determination unit 15 selects candidate cars of the first group according to a current registration condition of calls stored in the storage unit 14 (S102). The first determination unit 15 first selects all the cars that can provide serves as the candidate cars of the first group. Next, the first determination unit 15, for example, tentatively assigns the third-floor hall call to each of the cars. The first determination unit 15 excludes a certain car from the candidate cars of the first group if there is a possibility that the passenger may get in a wrong car in a case where the third-floor hall call is tentatively assigned to the certain car.

When the candidate cars of the first group are selected by the first determination unit 15, the second determination unit 16 selects candidate cars of the second group (S103). For example, the second determination unit 16 tentatively assigns the third-floor hall call to each of the cars selected in S102 as the candidate cars of the first group. If the upper and lower cars successively stop at the hall on the third floor in a case where the third-floor hall call is tentatively assigned, the second determination unit 16 excludes the tentatively assigned car from the candidate cars of the first group. The second determination unit 16 selects the car excluded from the candidate cars of the first group in S103 as a candidate car of the second group.

When the candidate cars of the first group are re-selected and the candidate cars of the second group are selected in S103, the assigned candidate car selection unit 17 determines whether there is a car selected as the candidate car of the first group (S104). If there is a car selected as the candidate car of the first group (Yes in S104), the assigned candidate car selection unit 17 selects such a car as an assigned candidate car.

When assigned candidate cars are selected by the assigned candidate car selection unit 17, the assigned car determination unit 18 calculates various evaluation values regarding each of the cars selected as the assigned candidate cars (S105). The assigned car determination unit 18 determines, based on the calculated comprehensive evaluation value, the assigned car corresponding to the call registered in S101 from the assigned candidate cars selected by the assigned candidate car selection unit 17 (S106).

If there is no car selected as a candidate car of the first group (No in S104), the assigned candidate car selection unit 17 selects the cars selected as the candidate cars of the second group as assigned candidate cars. When the assigned candidate cars are selected by the assigned candidate car selection unit 17, the assigned car determination unit 18 calculates various evaluation values regarding each of the cars selected as the assigned candidate cars (S107). The assigned car determination unit 18 determines, based on the calculated comprehensive evaluation value, the assigned car corresponding to the call registered in S101 from the assigned candidate cars selected by the assigned candidate car selection unit 17 (S106).

Therefore, the elevator system having the above configuration enables the passenger to get in an appropriate car without using a speaker and a display.

When the new call is registered from the destination call registration device 9, the first determination unit 15 excludes a certain car from the candidate cars of the first group if there is a possibility that the passenger may get in a wrong car in a case where the new registration call is assigned to the certain car. This can reliably prevent the passenger from getting in a wrong car arranged above or below the assigned car. When the passenger gets in the car, the passenger does not need to be aware that the car is the upper car or the lower car.

Moreover, the second determination unit 16 excludes the car, which causes upper and lower cars to successively stop at the same hall, from the candidate cars of the first group in a case where the new registration call is assigned to that car, then selects it as a candidate car of the second group. Thus, when the passenger gets in a car, the car does not stop again immediately after the passenger gets in the car. For example, the present elevator system can prevent a situation in which the upper car 2 simply stops and waits so that a passenger can get in and off the lower car 3. This elevator system, therefore, can enhance a transport efficiency.

As long as the assignment control unit 13 includes the second determination unit 16, an advantageous effect similar to the above can be achieved even if the assignment control unit 13 does not include the first determination unit 15. That is, as long as the assignment control unit 13 includes the second determination unit 16, the passenger can be prevented from getting in a wrong car arranged above or below the assigned car.

The present embodiment has been described using a case in which the group control device 12 performs group control of a plurality of double-deck elevators. The elevator device controlled by the group control device 12 may be a multi-deck elevator in which three or more cars are vertically coupled.

Second Embodiment

Figure 3:
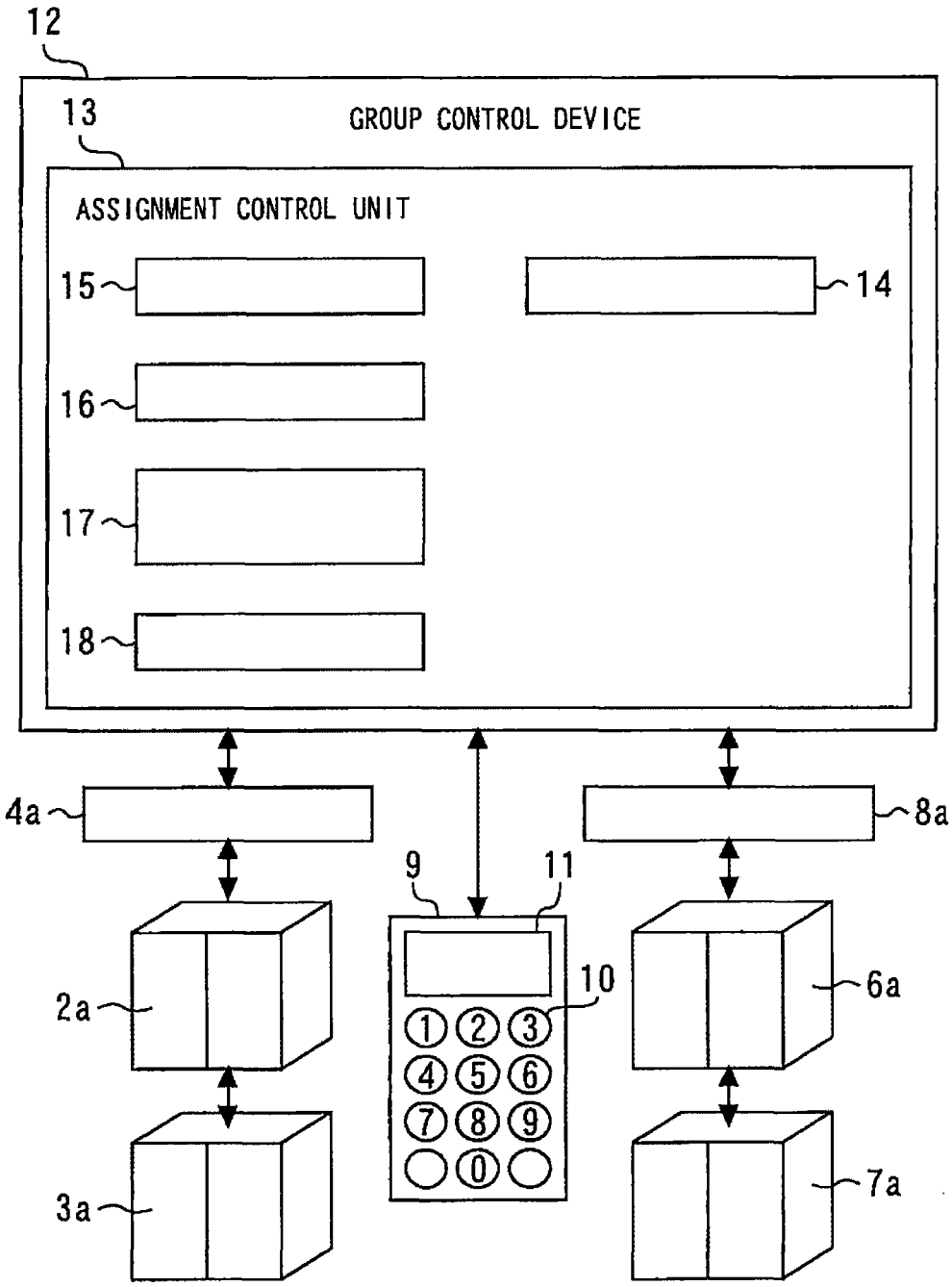
FIG. 3 is a diagram illustrating a configuration of an elevator system according to a second embodiment of the present invention.

FIG. 3 is a diagram illustrating a configuration of an elevator system according to a second embodiment of the present invention.

The present embodiment is described using a case in which a group control device 12 controls a plurality of one-shaft multi-car elevators as one group.

In FIG. 3, an upper car 2*a* and a lower car 3*a* ascend and descend in the same shaft. The lower car 3*a* is arranged below the upper car 2*a*. A car control device 4*a* controls opening and closing of doors and travelling of the upper car 2*a* and the lower car 3*a*. The upper car 2*a* and the lower car 3*a* are not vertically coupled, so that the upper car 2*a* and the lower car 3*a* can individually perform an ascending and descending operation and a door opening and closing operation.

An upper car 6*a* and a lower car 7*a* ascend and descend in a shaft different from that in which the upper car 2*a* and the lower car 3*a* ascend and descend. The upper car 6*a* and the lower car 7*a* ascend and descend in the same shaft. The lower car 7*a* is arranged below the upper car 6*a*. A car control device 8*a* controls opening and closing of doors and travelling of the upper car 6*a* and the lower car 7*a*. The upper car 6*a* and the lower car 7*a* are not vertically coupled, so that the upper car 6*a* and the lower car 7*a* can individually perform an ascending and descending operation and a door opening and closing operation.

Configurations and functions that are not disclosed in the present embodiment are similar to those disclosed in the first embodiment.

Also, when the group control of a plurality of one-shaft multi-car elevators is performed, the group control device 12 having a configuration similar to that of the first embodiment is employed, thereby achieving an advantageous effect similar to that in the first embodiment.

INDUSTRIAL APPLICABILITY

The elevator system according to the present invention can be applied to a system for performing group control of a plurality of elevator devices. The elevator device includes a plurality of cars which ascend and descend in the same shaft.

REFERENCE SIGNS LIST

1, 5 car device
2, 2*a*, 6, 6*a* upper car
3, 3*a*, 7, 7*a* lower car
4, 4*a*, 8, 8*a* car control device
9 destination call registration device
10 input button
11 display
12 group control device
13 assignment control unit
14 storage unit
15 first determination unit
16 second determination unit
17 assigned candidate car selection unit
18 assigned car determination unit

The invention claimed is:

1. An elevator system comprising:
a group control device which performs group control of a plurality of elevator devices; and
a destination call registration device, installed in an elevator hall, by which a passenger registers a destination call in the hall,
wherein each of the elevator devices includes a plurality of cars that ascend and descend in the same shaft, and
wherein the group control device includes:
a first determination unit which tentatively assigns a call newly registered from the destination call registration device to a first car, and excludes the first car from candidate cars of a first group in a case where a second car arranged above or below the first car stops at the hall before the first car; and
an assigned car determination unit which selects a car to which the new registration call is assigned from the candidate cars of the first group.

2. The elevator system according to claim 1, comprising:
a second determination unit which tentatively assigns the call newly registered from the destination call registration device to the first car in a case where the first car is selected as a candidate car of the first group by the first determination unit, and excludes the first car from the candidate cars of the first group to select the first car as a candidate car of a second group in a case where the first car and the second car successively stop at the hall,
wherein the assigned car determination unit selects a car to which the new registration call is assigned from the candidate cars of the first group in a case where there is a car selected as a candidate car of the first group, and selects a car to which the new registration call is assigned from candidate cars of the second group in a case where there is no car selected as a candidate car of the first group.

3. An elevator system comprising:
a group control device which performs group control of a plurality of elevator devices; and
a destination call registration device, installed in an elevator hall, by which a passenger registers a destination call in the hall,
wherein each of the elevator devices includes a plurality of cars that ascend and descend in the same shaft, and
wherein the group control device includes:
a second determination unit which tentatively assigns a call newly registered from the destination call registration device to a first car, and excludes the first car from candidate cars of a first group in a case where the first car and a second car arranged above or below the first car successively stop at the hall; and an assigned car determination unit which selects a car to which the new registration call is assigned from the candidate cars of the first group.

4. The elevator system according to claim 1, wherein each of the elevator devices is a multi-deck elevator in which a plurality of cars are vertically coupled to integrally ascend and descend in the same shaft.

5. The elevator system according to claim 1, wherein each of the elevator devices is a one-shaft multi-car elevator in which each of a plurality of cars is capable of individually ascending and descending in the same shaft.

6. The elevator system according to claim 3, wherein each of the elevator devices is a multi-deck elevator in which a plurality of cars are vertically coupled to integrally ascend and descend in the same shaft.

7. The elevator system according to claim 3, wherein each of the elevator devices is a one-shaft multi-car elevator in which each of a plurality of cars is capable of individually ascending and descending in the same shaft.

* * * * *